US009476546B2

(12) United States Patent
Croteau et al.

(10) Patent No.: US 9,476,546 B2
(45) Date of Patent: Oct. 25, 2016

(54) CURVED AND CONFORMAL HIGH-PRESSURE VESSEL

(71) Applicant: GOODRICH CORPORATION, Charlotte, NC (US)

(72) Inventors: Paul F. Croteau, Columbia, CT (US); Andrzej E. Kuczek, Bristol, CT (US); Wenping Zhao, Glastonbury, CT (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 14/671,787

(22) Filed: Mar. 27, 2015

(65) Prior Publication Data

US 2016/0281926 A1 Sep. 29, 2016

(51) Int. Cl.
*F17C 1/14* (2006.01)
*F17C 1/00* (2006.01)

(52) U.S. Cl.
CPC . *F17C 1/14* (2013.01); *F17C 1/00* (2013.01); *F17C 2201/0109* (2013.01); *F17C 2201/0152* (2013.01); *F17C 2203/0617* (2013.01); *F17C 2203/0639* (2013.01); *F17C 2203/0646* (2013.01); *F17C 2203/0663* (2013.01); *F17C 2209/221* (2013.01)

(58) Field of Classification Search
CPC ..... F17C 1/14; F17C 1/00; B65D 21/0205; B65D 21/0201; B65D 21/02
USPC ..... 220/581, 23.8, 23.2, 507, 500; 206/0.6
See application file for complete search history.

(56) References Cited

U.S. PATENT DOCUMENTS 3,191,792 A * 6/1965 Hunt ..... F17C 1/04 220/585
3,409,061 A * 11/1968 Struble, Jr. ..... F17C 3/02 206/524.1

FOREIGN PATENT DOCUMENTS

DE 701058 C * 1/1941 ..... E02D 5/08
FR 2739912 A1 * 4/1997 ..... F17C 1/00
GB 2121945 A * 1/1984 ..... B65D 88/02
SE WO 9313341 A1 * 7/1993 ..... B29C 65/02
SE WO 9630676 A1 * 10/1996 ..... F16J 12/00

* cited by examiner

*Primary Examiner* — Robert J Hicks
(74) *Attorney, Agent, or Firm* — Snell & Wilmer L.L.P.

(57) ABSTRACT

A high-pressure vessel is provided. The high-pressure vessel may comprise a first chamber defined at least partially by a first wall, and a second chamber defined at least partially by the first wall. The first chamber and the second chamber may form a curved contour of the high-pressure vessel. A modular tank assembly is also provided, and may comprise a first mid tube having a convex geometry. The first mid tube may be defined by a first inner wall, a curved wall extending from the first inner wall, and a second inner wall extending from the curved wall. The first inner wall may be disposed at an angle relative to the second inner wall. The first mid tube may further be defined by a short curved wall opposite the curved wall and extending from the second inner wall to the first inner wall.

15 Claims, 6 Drawing Sheets

CURVED AND CONFORMAL HIGH-PRESSURE VESSEL

GOVERNMENT LICENSE RIGHTS

This disclosure was made with government support under contract No. DE-AR0000254 awarded by the Department of Energy. The government has certain rights in the disclosure.

FIELD OF INVENTION

The present disclosure relates to high-pressure vessels, and, more specifically, to a curved and conformal high-pressure vessel.

BACKGROUND

Many engines rely on energy sources that are stored in storage tanks. For example, automobiles, aircraft, and boats may rely on storage tanks to store fuels such as gasoline, compressed natural gas, and propane. Similarly, compressed gasses such as nitrogen and carbon dioxide may be stored in tanks. The industry use of cylinders for compressed natural gas, for example, is limited at least in part because large, bulky cylinders fill large volumes and reduce available cargo space. Cylindrical tanks have a conformability ratio (i.e., the ratio of overall tank volume to equivalent rectangular envelope) of approximately 70%. The inefficient use of onboard vehicle space may decrease the volume efficiency of current cylindrical tanks.

SUMMARY

A high-pressure vessel may comprise a first chamber defined at least partially by a first wall, and a second chamber defined at least partially by the first wall. The first chamber and the second chamber may form a curved contour of the high-pressure vessel.

In various embodiments, the first chamber may be at least partially defined by a second wall oriented at an acute angle relative to the first wall. A curved wall may be at least partially defining the first chamber, and a circular wall may at least partially define the second chamber, wherein the curved wall and the circular wall meet at a substantially 120° angle. The circular wall, the first wall, and the curved wall may have a same thickness. The curved contour may comprise at least one of an S-shaped contour, a multi-radial contour, or a non-uniformly curved contour. The first chamber may be a mid tube and the second chamber may be an end tube. The end tube and the mid tube may be welded together. The end tube and the mid tube may also comprise at least one of aluminum, steel, or composite.

A modular tank assembly may comprise a first mid tube having a convex geometry. The first mid tube may be defined by a first inner wall, a curved wall extending from the first inner wall, and a second inner wall extending from the curved wall. The first inner wall may be disposed at an angle relative to the second inner wall. The first mid tube may further be defined by a short curved wall opposite the curved wall and extending from the second inner wall to the first inner wall. A second mid tube has a second convex geometry and defined at least partially by the first inner wall.

In various embodiments, the second mid tube may further comprise a second curved wall that meets the curved wall of the first mid tube at a 120° angle. The first inner wall, the second inner wall, the curved wall, and the short curved wall may have an equal thickness. The modular tank assembly may have at least one of an S-shaped, multi-radial, curved, or non-uniformly curved contour. An end tube may be coupled to the first mid tube and have a circular wall that meets the curved wall at a 120° angle. The first inner wall may at least partially define the end tube. The first mid tube and the second mid tube may be welded together.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Figure 1:
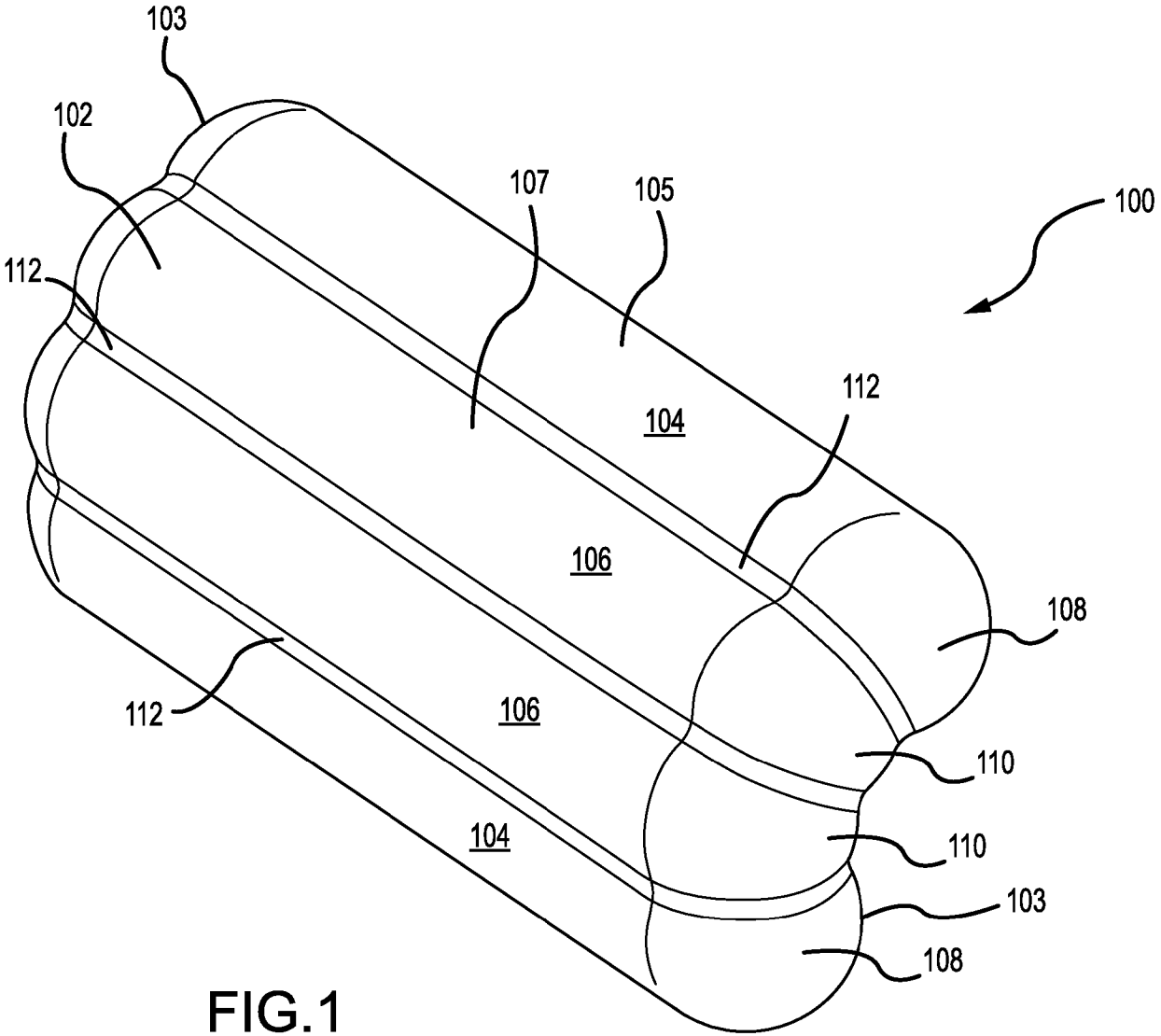
FIG. 1 illustrates a perspective view of a high-pressure vessel having a curved contour, in accordance with various embodiments.
Figure 2:
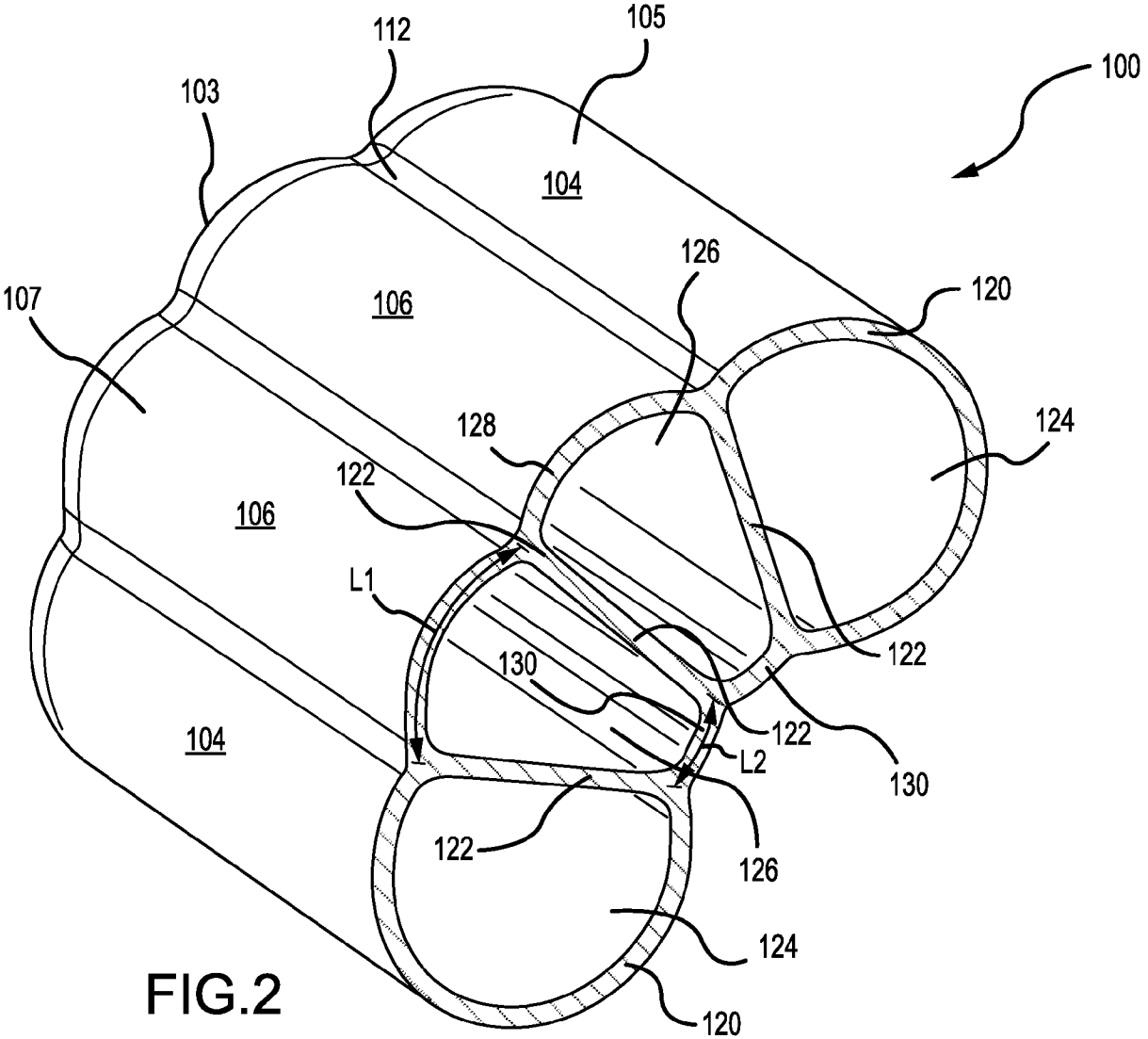
FIG. 2 illustrates a perspective view of a cutaway high-pressure vessel having a curved contour, in accordance with various embodiments.
Figure 3:
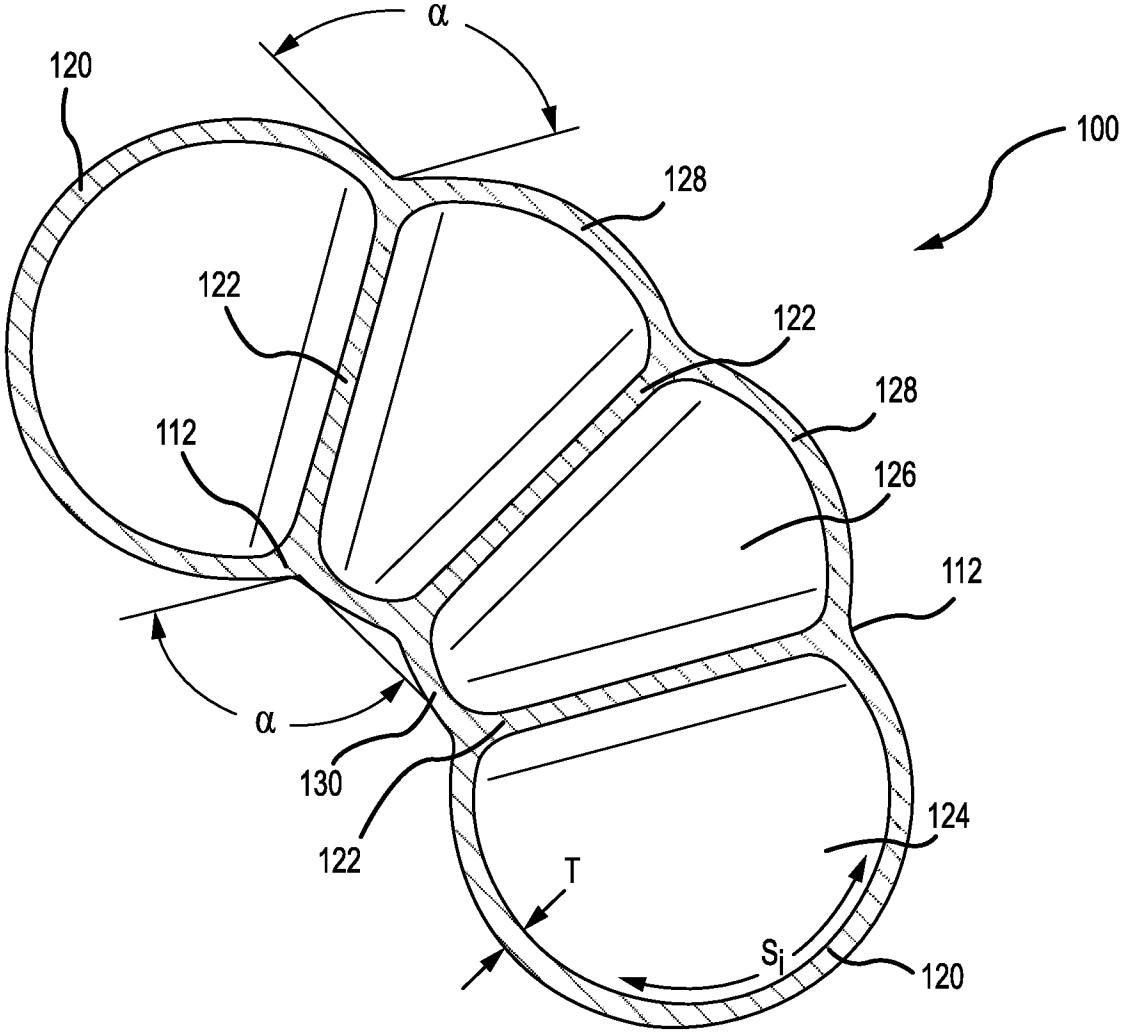
FIG. 3 illustrates a cross-sectional view of a high-pressure vessel having a curved contour, in accordance with various embodiments.

With reference to FIGS. 1-3, a high-pressure vessel 100 is shown with outer surface 102 spanning across end tubes 104, intersections 112, and mid tubes 106, in accordance with various embodiments. High-pressure vessel 100 may comprise a curved contour produced by the geometry of each end tubes 104 and mid tubes 106. End tubes 104 may be capped by end cap 108 having a spherical contour. Mid tubes 106 may be capped by end caps 110 having a substantially spherical contour. Intersections 112 may join end tubes 104 and mid tubes 106 together. Each mid tubes 106 and end tubes 104 may be fabricated separately and welded together to form high-pressure vessel 100.

In various embodiments, end-tube body 105 may be an elongated, concave body having a partially circular cross section that defines a chamber 124 when joined with end cap 108. Similarly, mid-tube body 107 may be an elongated, concave body having a substantially trapezoidal cross section that defines a chamber 126 when joined with end cap 110. Chamber 124 and chamber 126 may each be partially defined by inner wall 122. Chamber 124 and chamber 126 may also define a curved contour of high-pressure vessel 100, described further below. In that regard, a chamber may be a mid tube or end tube. As shown in the cross-sectional view of FIG. 2, end tubes 104 may have a D-shape comprising a circular wall 120 and an inner wall 122 having a flat and straight geometry. Inner wall 122 and circular wall 120 may extend an end cap 108 (with momentary reference back to FIG. 1) at a first end of end-tube body 105 to a second end cap 108 at the opposite side of end-tube body 105. The D-shaped end tubes 104 may be disposed at either end 103 of high-pressure vessel 100 with one or more mid tubes 106 coupled between end tubes 104.

In various embodiments, mid tubes 106 may have a trapezoidal cross section comprising a curved wall 128, two flat and straight inner walls 122 extending inward from either end of curved wall 128, and a short curved wall 130 that meets the inner walls 122 at a location opposite curved wall 128. The length $L_2$ along surface 107 of short curved wall 130 may be less than the length $L_1$ of curved wall 128. In that regard, inner walls 122 tend to be disposed closer together at positions closer to short curved wall 130. Similarly, inner walls 122 tend to be disposed further apart at positions closer to curved wall 128. Inner wall 122 and circular wall 120 may extend from an end cap 110 at a first end of mid-tube body 107 to a second end cap 110 at the opposite side of mid-tube body 107. The mid tubes 106 may be disposed central to two end tubes 104 of high-pressure vessel 100. In that regard, an end tube 104 may share an inner wall 122 with mid tube 106 disposed adjacent the end tube 104.

With reference to FIG. 3, relationships between internal and external walls of high-pressure vessel 100 are shown, in accordance with various embodiments. Circular wall 120, inner wall 122 and curved wall 128 meet at an intersection 112. Circular wall 120, short curved wall 130, and inner wall 122 also meet at an intersection 112. Similarly, inner wall 122 may meet with two short curved walls 130 at an intersection 112. Inner wall 122 may also meet two curved walls 128 at an intersection 112.

In various embodiments, each intersection 112 has a Y-shaped geometry when viewed in cross section. The Y-shape comprises an angle $\alpha$ defined by the tangent lines of circular walls 120, curved walls 128, and/or short curved walls 130 at an intersection 112 where the walls meet. The contours of circular walls 120, curved walls 128, and/or short curved walls 130 may be selected to ensure that angle $\alpha$ is always substantially 120°. Substantially 120° is used to mean 120°+/−5°, with each 120° referred to herein being substantially 120°. Circular walls 120, curved walls 128, and/or short curved walls 130 angled at 120° along intersections 112 transfer load from the outer hoop or outer walls of high-pressure vessel 100 inward to a tensile load direction (i.e., along inner walls 122). In that regard, inner walls 122 may share the stress loads on high-pressure vessel 100 and produce substantially uniform stress loads along surfaces of the high-pressure vessel.

In various embodiments, each wall in high-pressure vessel 100 may have a uniform thickness T. That is, circular wall 120, inner wall 122, curved wall 128, and short curved wall 130 may each have thickness T that is substantially equal to the other walls. The thickness T may be selected to provide a balance between strength and weight of high-pressure vessel 100 and to sustain a desired internal pressure. The combination of substantially equal and uniform wall thickness with 120° intersection of outer walls (i.e., circular wall 120, short curved wall 130, and curved wall 128) and inner supports (i.e., inner wall 122) produces load sharing of the pressure load where the inner diameter stress S, of the wall is hoop stress of a similarly sized cylinder. Each inner wall 122 may be set an acute angle relative to other inner walls 122, with the angle determined by the number of segments need to make up the total angle of the assembly.

In various embodiments, the stress in the inner wall 122 is tensile and is essentially equal to the hoop stress of the inner surfaces of circular wall 120, short curved wall 130, and curved wall 128. A stress of slightly greater magnitude may exist localized near the fillet at intersection 112 of the outer wall to inner support. The fillet can be sized to minimize the effect of the stress concentration caused by change of the load path in the wall. The expected increase of tank conformability (i.e., the ratio of overall tank volume to equivalent rectangular envelope) to as much as 92% provides volume efficiency with additional flexibility to place tank against curved structures (e.g., a boat hull or an aircraft fuselage). The higher conformability increases the amount of gas that can be stored in a given space.

In various embodiments, high-pressure vessel may be formed from high-strength materials or light weight metals to allow for thinner walls and lower weights than might be realized with lower-strength materials such as aluminum, steel, or composites. For example, high-pressure vessel 100 may be fabricated using high-strength, 7000 series aluminum (i.e., aluminum alloyed with zinc and optionally precipitate hardened) or high-strength steel. Referring to FIGS. 1-3, each mid tube 106 and end tube 104 may be formed independently of other mid tubes and end tubes and subsequently welded together to form high-pressure vessel 100. In that regard, high-pressure vessel 100 may be a modular tank assembly.

In various embodiments, the core of high-pressure vessel could be manufactured from an integral extrusion of the entire cross section including mid tubes 106 and end tubes 104. The core of high-pressure vessel 100 could also be formed as individual segments that are bonded together. Bonding methods could be any fusion or solid state method used for joining metals, including, but not limited to Tungsten Inert Gas (TIG), laser electron beam, friction stir welding, or flash upset butt welding. The end caps 108 and 110 are essentially spherical in shape except for where the inner wall 122 needs to be positioned. The end caps 108 and 110 could be manufactured as part of the core using forging, hydroforming, or other extrusion method, or individually and bonded to the core.

In various embodiments, high-pressure vessel 100 may also be formed using composite materials. Chopped fiber, a hybrid of chopped and continuous fiber, continuous fiber, and/or fiber fabric may be used to form high-pressure vessel 100. The composite material may be formed with a resin and the fiber formed into the shape of high-pressure vessel 100. Each end tube 104 and mid tube 106 may be formed, for example, by placing pre-impregnated composite fibers around a mandrel in the shape of each end tube 104 or mid tube 106. End tubes 104 and mid tubes 106 may then be pressed together with an additional layer and the pre-impregnated composite material wrapped around the outer surfaces of end tubes 104 and mid tubes 106 to ensure uniform wall thickness. The entire high-pressure vessel 100, including end caps 108 and 110 may be cured as a unitary composite structure using a pressurized autoclave.

Figure 4A:
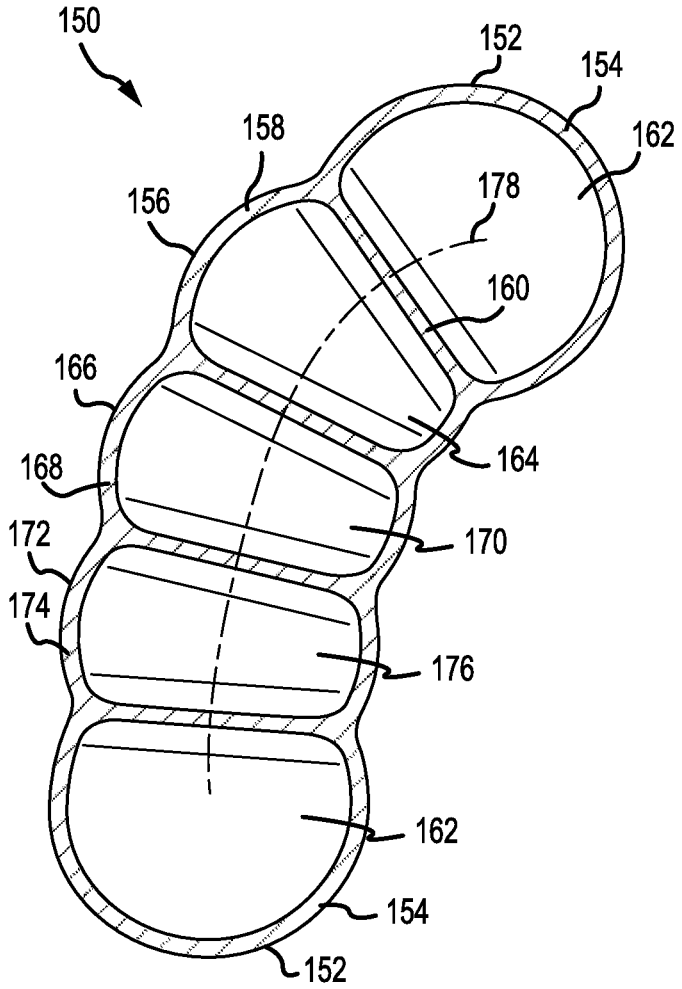
FIG. 4A illustrates a high-pressure vessel having an asymmetric and multi-radial contour, in accordance with various embodiments.
Figure 4B:
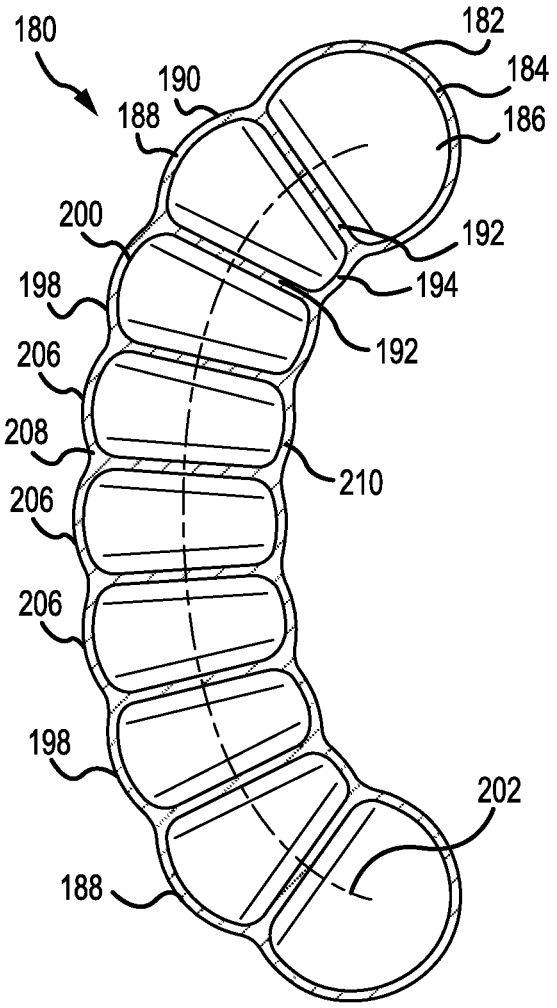
FIG. 4B illustrates a high-pressure vessel having a symmetric and multi-radial contour, in accordance with various embodiments.
Figure 4C:
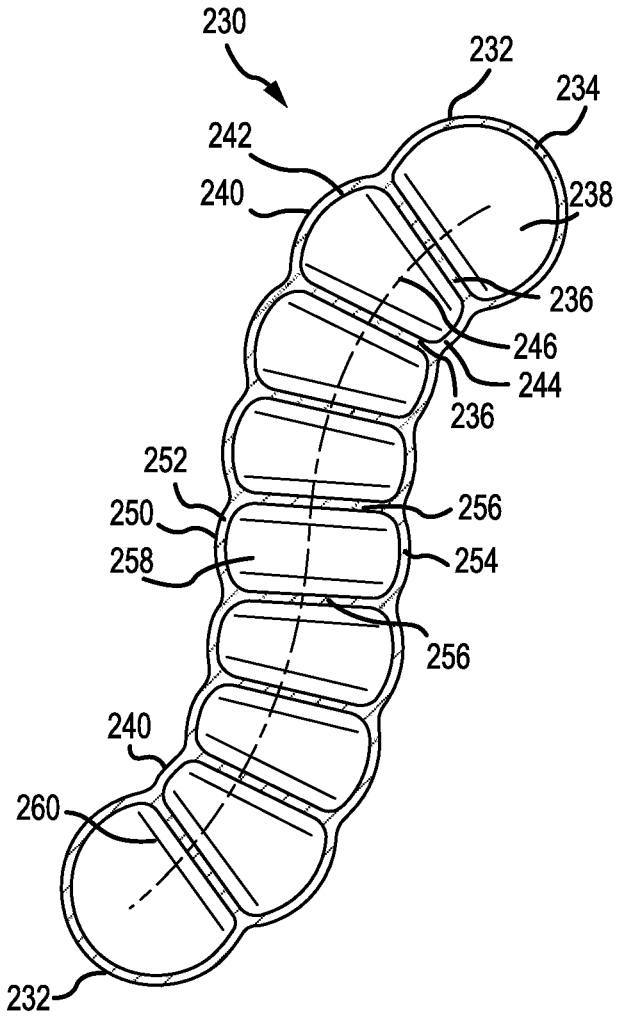
FIG. 4C illustrates a high-pressure vessel having an s-shaped contour, in accordance with various embodiments.

With reference to FIGS. 4A-4C, high-pressure vessels are shown in non-uniformly curved configurations, in accordance with various embodiments. In FIG. 4A, high-pressure vessel 150 is formed with its cross section following non-uniform curve 178 (i.e., a multi-radial curve or non-radial curve). End tubes 152 are disposed with high-angle mid tube 156, mid tube 166, and slightly angled mid tube 172 coupled between end tubes 152. End chamber 162 may be defined by circular wall 154 and inner wall 160. Inner walls 160 may be angled relative to one another at different angles to produce non-uniform curve 178. Curved wall 158 may meet circular wall 154 at an intersection with the tangent of each surface at the intersection meeting at an angle of 120°. Each intersection between curved wall 158, curved wall 168, curved wall 174, short curved wall 164, short curved wall 170, short curved wall 176, and circular wall 154 may be formed with the walls meeting at a 120° angle relative to one another. Mid tubes of high-pressure vessel 150 may each have a different geometry to provide non-uniform curve 178. Each wall in high-pressure vessel 150 may have substantially similar thickness (as shown in FIG. 3) and meet at 120° intersections to provide uniform stress loads throughout high-pressure vessel 150.

With reference to FIG. 4B, a high-pressure vessel 180 is shown having a symmetric and multi-radial contour, in accordance with various embodiments. End tubes 182 are disposed with high-angle mid tube 190, mid tube 198, and slightly angled mid tubes 206 coupled between end tubes 182. End tube 182 may be defined by circular wall 184 and inner wall 192. Inner walls 192 may be angled relative to one another at different angles to produce multi-radial curve 202. Curved wall 188 may meet circular wall 184 at an intersection with the tangent of each surface at the intersection meeting at an angle of 120°. Each intersection between curved wall 188, curved wall 200, curved wall 208, short curved wall 194, short curved wall 210, and circular wall 184 may be formed with the walls meeting at a 120° angle relative to one another. Mid tubes of high-pressure vessel 150 may each have a different geometry to provide multi-radial curve 202. Each wall in high-pressure vessel 150 may have substantially similar thickness (as shown in FIG. 3) and meet at 120° intersections to provide uniform stress loads throughout high-pressure vessel 150.

With reference to FIG. 4C, a high-pressure vessel 230 is shown having an s-shaped contour, in accordance with various embodiments. End tubes 232 are disposed with angled mid tubes 240 and straight mid tube 250 coupled between end tubes 232. End tube 232 may be defined by circular wall 234 and inner wall 236. Inner walls 236 may be angled relative to one another at different angles to produce multi-radial curve 202. Parallel inner walls 256 may be substantially parallel to one another to form a straight mid tube 250 that does not curve. Parallel inner walls 256 may also be disposed at angles relative to inner walls 236. Curved wall 242 may meet circular wall 234 at an intersection with the tangent of each surface at the intersection meeting at an angle of 120°. Each intersection between curved wall 242, curved wall 252 of straight mid tube 250, curved wall 254 of straight mid tube 250, short curved wall 244, and circular wall 234 may be formed with the walls meeting at a 120° angle relative to one another.

In various embodiments, curved wall 252 and curved wall 254 of straight mid tube 250 may have substantially similar lengths to span between parallel inner walls 256. Mid tubes of high-pressure vessel 230 may each have a different geometry to provide s-shaped curve 246. Each wall in high-pressure vessel 150 may have substantially similar thickness (as shown in FIG. 3) and meet at 120° intersections to provide uniform stress loads throughout high-pressure vessel 150.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35

U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A high-pressure vessel, comprising:

a first chamber defined at least partially by a first wall; and a second chamber defined at least partially by the first wall, wherein the first chamber and the second chamber form a curved contour of the high-pressure vessel; a curved wall at least partially defining the first chamber; and a circular wall at least partially defining the second chamber, wherein the curved wall and the circular wall meet at a substantially 120° angle.

2. The high-pressure vessel of claim 1, wherein the first chamber is at least partially defined by a second wall oriented at an acute angle relative to the first wall.

3. The high-pressure vessel of claim 1, wherein the circular wall, the first wall, and the curved wall have a same thickness.

4. The high-pressure vessel of claim 1, wherein the curved contour comprises at least one of an S-shaped contour, a multi-radial contour, or a non-uniformly curved contour.

5. The high-pressure vessel of claim 1, wherein the first chamber is a mid tube and the second chamber is an end tube.

6. The high-pressure vessel of claim 5, wherein the end tube and the mid tube are welded together.

7. The high-pressure vessel of claim 5, wherein the end tube and the mid tube comprise at least one of aluminum, steel, or a composite.

8. A modular tank assembly, comprising:

a first mid tube having a convex geometry and defined by a first inner wall, a curved wall extending from the first inner wall, a second inner wall extending from the curved wall, wherein the first inner wall is disposed at an acute angle relative to the second inner wall, and a short curved wall opposite the curved wall and extending from the second inner wall to the first inner wall; and a second mid tube having a second convex geometry and defined at least partially by the first inner wall; wherein the second mid tube further comprises a second curved wall that meets die curved wall of the first mid tube at a substantially 120° angle.

9. The modular tank assembly of claim 8, wherein the first inner wall, the second inner wall, the curved wall, and the short curved wall have an equal thickness.

10. The modular tank assembly of claim 8, further comprising at least one of an S-shaped, multi-radial, curved, or non-uniformly curved contour.

11. The modular tank assembly of claim 8, further comprising an end tube coupled to the first mid tube, wherein the end tube comprises a circular wall that meets the curved wall at a substantially 120° angle.

12. The modular tank assembly of claim 11, wherein the first inner wall at least partially defines the end tube.

13. The modular tank assembly of claim 11, wherein the end tube is at least partially defined by the second inner wall.

14. The modular tank assembly of claim 8, wherein the first mid tube and the second mid tube are welded together.

15. The modular tank assembly of claim 8, wherein the first mid tube comprises an end cap having a spherical shape.

* * * * *